US007654912B1

(12) United States Patent
Hooten

(10) Patent No.: US 7,654,912 B1
(45) Date of Patent: Feb. 2, 2010

(54) GOLFING STANCE TRAINING APPARATUS AND METHOD

(76) Inventor: James C. Hooten, 5525 Lazy Acres Trail, Pinson, AL (US) 35126

( * ) Notice: Subject to any disclaimer, the term of this patent is extended or adjusted under 35 U.S.C. 154(b) by 0 days.

(21) Appl. No.: 12/218,648

(22) Filed: Jul. 18, 2008

(51) Int. Cl.
*A63B 69/36* (2006.01)

(52) U.S. Cl. ..... 473/266; 473/207

(58) Field of Classification Search ..... 473/207, 473/217–219, 266, 269–271, 409, 422
See application file for complete search history.

(56) References Cited

U.S. PATENT DOCUMENTS

| | | | | |
|---|---|---|---|---|
| 4,045,033 | A * | 8/1977 | Schuman | 473/266 |
| 4,340,222 | A * | 7/1982 | Kerkenbush et al. | 473/610 |
| 4,993,716 | A | 2/1991 | Waller | |
| 5,148,712 | A * | 9/1992 | Cross et al. | 73/756 |
| 5,242,348 | A * | 9/1993 | Bates | 482/105 |
| 5,303,927 | A | 4/1994 | Perry et al. | |
| D397,395 | S | 8/1998 | Massey | |
| 5,830,079 | A | 11/1998 | Hudson | |
| 5,839,968 | A * | 11/1998 | Latella | 473/219 |
| 6,068,580 | A * | 5/2000 | Myers et al. | 482/93 |
| 6,176,790 | B1 * | 1/2001 | Latella | 473/219 |
| 6,332,845 | B1 * | 12/2001 | Priestley | 473/207 |
| 6,575,885 | B1 | 6/2003 | Weck et al. | |
| 7,033,282 | B1 | 4/2006 | Flood | |
| 2001/0041623 | A1 | 11/2001 | Rosselli | |
| 2002/0173368 | A1 | 11/2002 | Lane | |
| 2004/0110582 | A1 * | 6/2004 | Kennedy et al. | 473/593 |
| 2006/0040757 | A1 | 2/2006 | Rosselli | |
| 2006/0154758 | A1 * | 7/2006 | Laliberty et al. | 473/593 |

* cited by examiner

*Primary Examiner*—Nini Legesse

(57) ABSTRACT

A golfing stance training apparatus and method includes a spherical housing has a diameter between 5 inches and 9 inches. The housing is comprised of an elastic material and is inflated. The housing is positioned between a person's legs so that the housing is positioned adjacent to knees of the legs and the legs support the housing over a ground surface. A golf swing is made a golf swing by the person while retaining the housing between and supported by the legs.

1 Claim, 4 Drawing Sheets

GOLFING STANCE TRAINING APPARATUS AND METHOD

BACKGROUND OF THE INVENTION

Field of the Invention

The present invention relates to golf stance training devices and more particularly pertains to a new golf stance training device for assisting a person in learning the proper positioning and movement of their legs during a golf swing.

SUMMARY OF THE INVENTION

The present invention meets the needs presented above by generally providing a spherical housing has a diameter between 5 inches and 9 inches. The housing is comprised of an elastic material and is inflated. The housing is positioned between a person's legs so that the housing is positioned adjacent to knees of the legs and the legs support the housing over a ground surface. A golf swing is made a golf swing by the person while retaining the housing between and supported by the legs.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
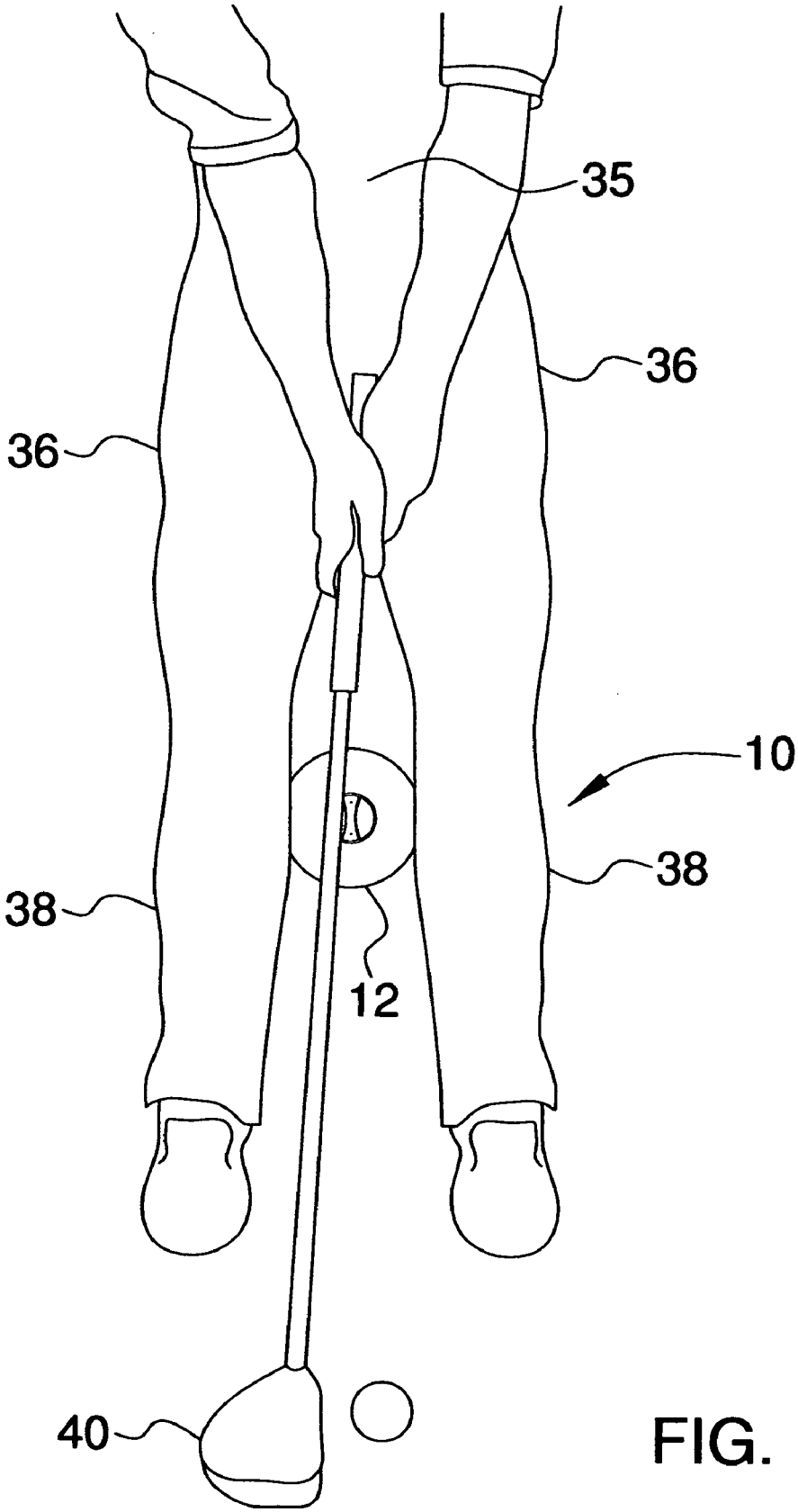
FIG. 1 is a front perspective view of a golfing stance training apparatus and method according to the present invention.

With reference now to the drawings, and in particular to FIGS. 1 through 7 thereof, a new golf stance training device embodying the principles and concepts of the present invention and generally designated by the reference numeral 10 will be described.

As best illustrated in FIGS. 1 through 7, the golfing stance training apparatus and method 10 generally comprises providing a spherical housing 12 that has a diameter between 5 inches and 9 inches. The housing 12 is comprised of an elastic material and is inflated. An inflating and deflating assembly

14 is positioned in the housing 12 and is actuatable to selectively inflate or collapse the housing 12. The housing 12 is collapsible so that it may be easily stored in a golf bag when not in use. The assembly 14 biases opposite sides of the housing 12 apart from each other when the assembly 14 is actuated to inflate the housing 12. The assembly 14 includes a pair of saddles 16 mounted to a perimeter wall 18 of the housing 12 and positioned in the housing 12. The saddles 16 are positioned opposite of each other and each has at least one air opening 20 extending therethrough and being in fluid communication with an interior 22 of the housing 12. One or more support arms 24 are attached to and extend between the saddles 16. The supports arms 24 are articulating and may be collapsed or straightened. When straightened, by rotating and pulling the saddles 16 away from each other, the support arms 24 bias the saddles 16 away from each other and draw air into the housing 12 through the saddles 16. When collapsed, by rotating the saddles 16 in an opposite direction and pushing them toward each other, air is forced from the housing 12 through the saddles 16.

Figure 2:
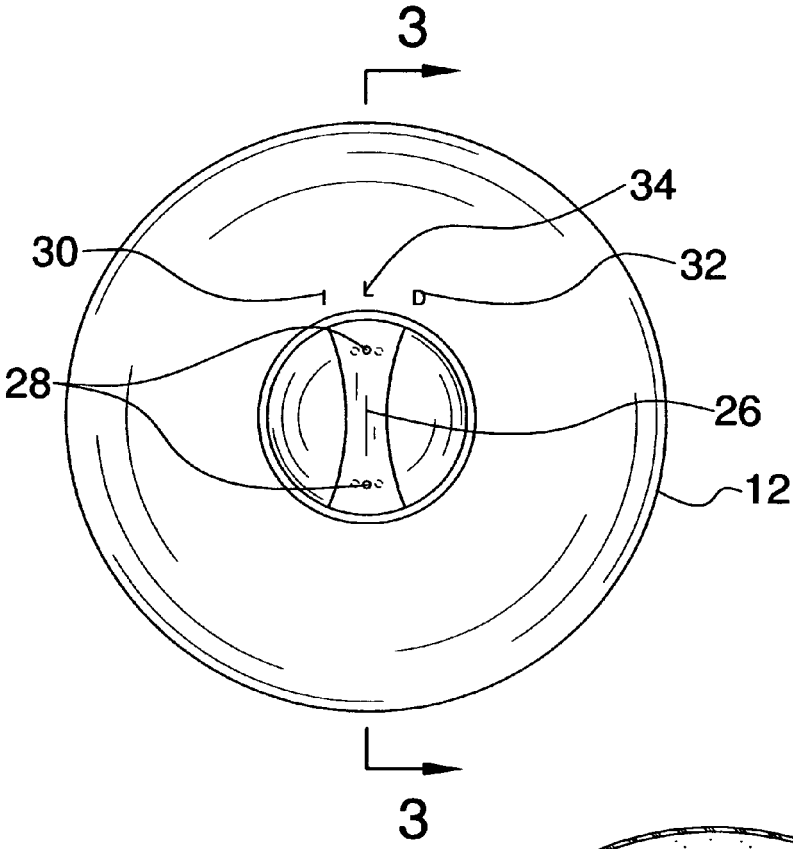
FIG. 2 is a front view of the present invention.
Figure 3:
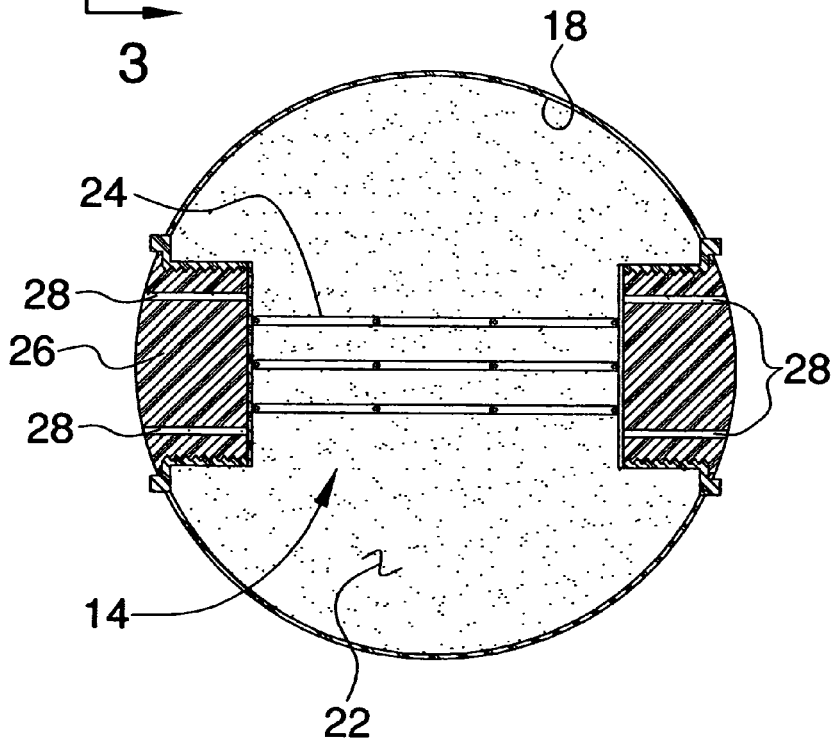
FIG. 3 is a cross-sectional view taken along line 3-3 of FIG. 2 of the present invention.
Figure 4:
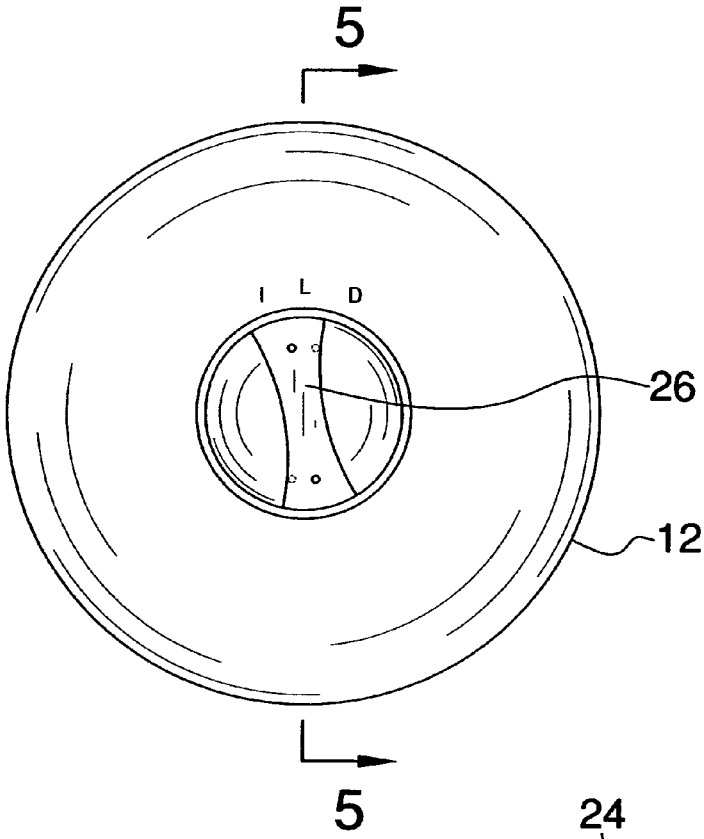
FIG. 4 is a front view of the present invention.
Figure 5:
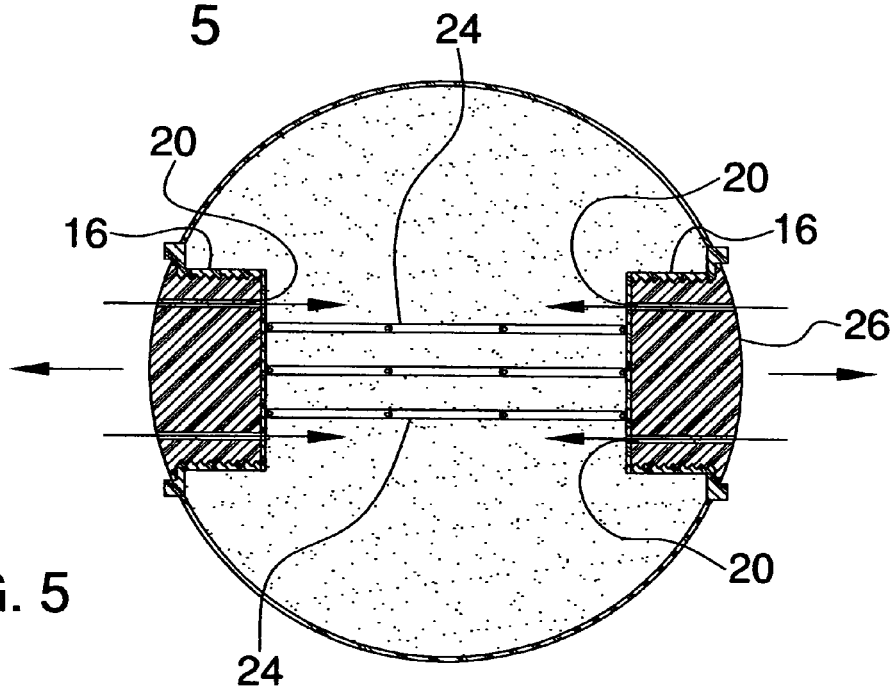
FIG. 5 is a cross-sectional view taken along line 5-5 of FIG. 4 of the present invention.
Figure 6:
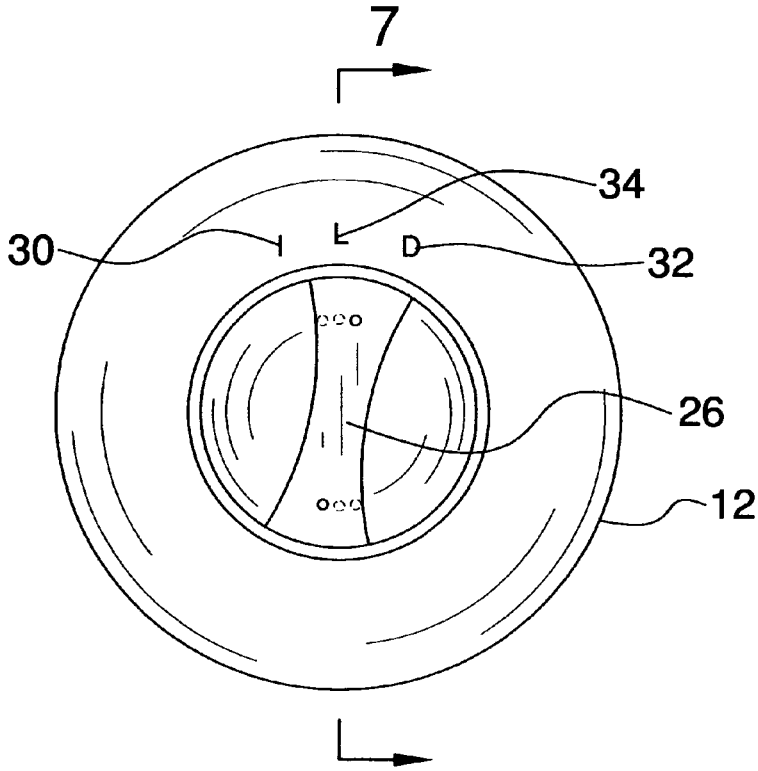
FIG. 6 is a front view of the present invention.
Figure 7:
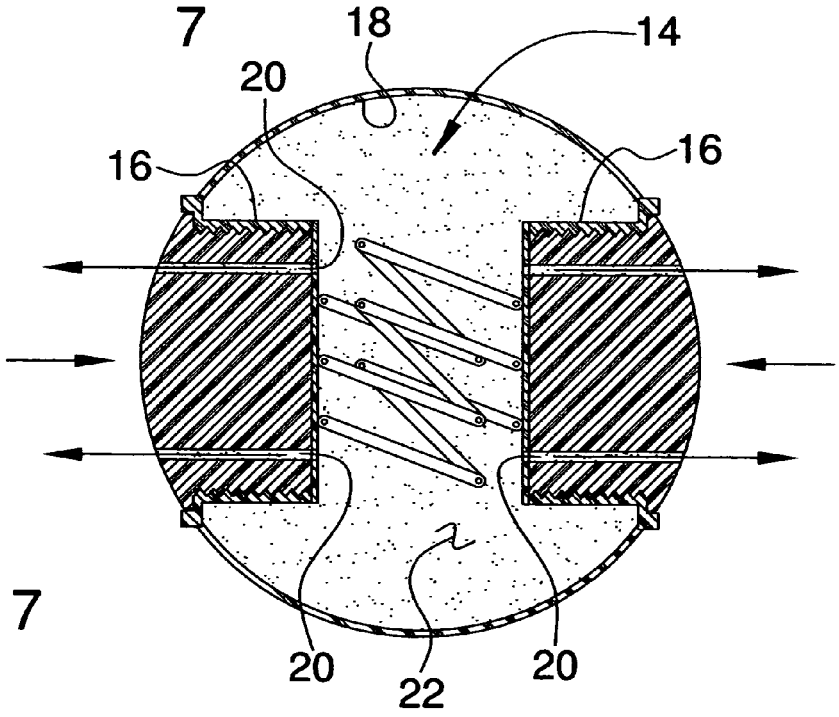
FIG. 7 is a cross-sectional view taken along line 7-7 of FIG. 6 of the present invention.

Each of the saddles 16 includes a grip 26 mounted therein. The grips 26 are rotatable with respect to the saddles 26. The grips 26 include air conduits 28 that may be aligned or unaligned with the air openings 20 to either close or open the air openings 20. The housing 12 may have indicia thereon to assist a person in understanding which direction the grips 26 should be rotated to either extend or collapse the support arms 24 and to open up the air openings 20. The indicia may include an inflation indicator 30, a deflating indicator 32 and a locking indicator 34. The locking indicator 34 closes the pathway between the air conduits 28 and the air openings 20. FIGS. 2 and 3 show locking actuation, FIGS. 4 and 5 show inflating actuation and FIGS. 6 and 7 show deflating actuation.

In use, the housing 12 is inflated, if was in a collapsed position, and the housing 12 is positioned between a person's 35 legs 36 so that housing 12 is positioned adjacent to knees 38 of the legs 36 and the legs 36 support the housing 12 over a ground surface. The person 35 then makes a conventional golf swing while retaining the housing 12 between and supported by the legs 36. This prevents excessive movement of the legs 36 to retain them in proper positioning throughout the golf swing. During the process of making several golf swings with a golf club 40, the person's muscles will become trained to remain in the proper position without the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf stance training apparatus comprising:

a spherical housing having a diameter between 5 inches and 9 inches, said housing being comprised of an elastic material and being inflated;

wherein said housing is positioned said housing between a person's legs so that housing is positioned adjacent to knees of the legs and the legs support the housing over a ground surface, and wherein a golf swing is made by the person while retaining the housing between and supported by the legs;

an inflating and deflating assembly is positioned in said housing, said assembly being actuatable to selectively inflate or collapse said housing, said assembly biasing opposite sides of said housing apart from each other when said assembly is actuated to inflate said housing;

a pair of saddles mounted to a perimeter wall of said housing and being positioned in said housing, said saddles being positioned opposite of each other and each having at least one air opening extending therethrough in fluid communication with an interior of said housing;

at least one support arm being attached to and extending between said saddles, said at least one support arm being articulating and may be selectively collapsed or straightened, said at least one support arm being straightened by when said saddles are rotated and pulled apart with respect to each other, said at least one support arm biasing said saddles away from each other when said at least one support arm is straightened to draw air into said housing through said at least one air opening; and a pair of grips, each of said saddles having one of said grips rotatable mounted therein, said grips being rotatable with respect to said saddles, said grips including air conduits selectively aligned or misaligned with said at least one air opening to either open or close said at least one air opening.

* * * * *